United States Patent [19]

Bündgen

[11] 4,424,821

[45] Jan. 10, 1984

[54] PERMANENT WAVE ROLLER

[76] Inventor: Joseph Bündgen, Wilhelmshöher Allee 273, 35 Kassel, Fed. Rep. of Germany

[21] Appl. No.: 235,762

[22] Filed: Feb. 18, 1981

[30] Foreign Application Priority Data

Feb. 21, 1980 [DE] Fed. Rep. of Germany ..... 3006459

[51] Int. Cl.[3] ..... A45D 2/00

[52] U.S. Cl. ..... 132/40

[58] Field of Search ..... 132/40, 42, 39, 38

[56] References Cited

U.S. PATENT DOCUMENTS

| | | | |
|---|---|---|---|
| 2,565,673 | 8/1951 | Yven et al. | 132/39 |
| 2,747,585 | 5/1956 | Allen, Jr. | 132/42 R |
| 3,113,578 | 12/1963 | Krowley | 132/40 |
| 3,812,866 | 5/1974 | Morane | 132/40 |

FOREIGN PATENT DOCUMENTS

| | | | |
|---|---|---|---|
| 2607407 | 8/1977 | Fed. Rep. of Germany | 132/40 |
| 1065492 | 1/1954 | France | 132/42 R |

*Primary Examiner*—Gregory E. McNeill

[57] ABSTRACT

Permanent wave roller having a rotation-symmetrical winding rod or winding tube and a hair fastening means, wherein the winding rod or winding tube has three segments adjoining one another in the direction of the axis of rotation, the middle segment (4) of which has the smallest outside diameter while the outer two segments (5, 6) are of different length and have a gradually increasing outside diameter, the enlargement of this outside diameter per unit of length increasing gradually in each case from the side adjacent the center segment (4) toward the associated roller end (FIG. 2).

13 Claims, 3 Drawing Figures

PERMANENT WAVE ROLLER

This invention relates to a permanent wave roller of the type described in the definition portion of claim 1.

There are many different sizes and types of permanent wave rollers. In addition to simple cylindrical, rod and tube type permanent wave rollers using strings or elastic bands to secure the hair, there are also spiral and flat rollers.

Spiral rollers consist of a cylindrical winder rod or a winder tube having a spiral groove in the outer casing, the hair being wound into this groove, starting from the root end and proceeding to the tip. Using rollers of this type, intended in particular for long hair and to obtain soft waves, it is impossible to achieve satisfactory results from the point of view of good appearance and durability of the waves that are produced with them.

On the other hand, in the majority of cases, flat rollers have winder rods or winder tubes of the type described in the introduction, the middle segment being arranged symmetrically between two equally long outer segments, these outer segments being configured as cones having the same rise. When rollers of this kind are used, the hair is usually rolled on from the tip to the root end, whereupon the tip usually lies in the area of the middle segment, that has the smallest diameter, in order that a tight tip curl and an looser root-end curl are obtained. Quite apart from the fact that permanent waves that are set in this manner are frequently too sharp, it is impossible to produce ringlets with this type of flat roller since winding from the root to the tip is impossible because of the pronounced conicity and/or the fact that this leads to too loose a root curl and too tight a tip curl.

Furthermore, a feature common to both types of roller is that their dimensions are not matched to the different existing hair types and/or hair lengths, so that in some cases there is insufficient space on the scalp for the number of rollers required, and/or to use a selection of rollers depending on the permanent wave form to be achieved or the form of the hair prior to the treatment.

The invention undertakes the task of developing a permanent wave roller of the type described in the introduction to the point that it is more versatile and ensures good shape and durability of the permanent wave.

The distinguishing features of claim 1 are intended to achieve these ends.

The invention entails the advantage that, as a result of the special form of the rollers, the hair can be rolled up in the usual manner as it is in the case of both spiral and flat rollers. It is also advantageous that, because of the asymmetrical arrangement of the middle segments it is possible to start rolling the hair on at either end of the roller, which means that the particular hair length and/or structure in the individual case can be accorded optimal consideration. Thus, tight root-end curls and looser tip curls, or vice versa, and ringlets can be produced as desired, since the roller can be used in different positions vis-a-vis the shape of the head.

In one particularly expedient embodiment of the invention a set of several permanent wave rollers of different lengths, preferably between 30 and 140 mm, is provided, in which the three segments are of lengths, outside diameters and outside diameter increases that are configured according to the typical hair lengths and/or structures. This means that a sufficient number of different rollers is always available and can be used in combination according to the requirements of each individual case.

When the rollers according to the invention are used a very durable, elastic permanent wave that fluffs up the hair and gives it fullness is obtained, even in those cases where existing permanent wave rollers fail to do so. The coiffure has more body for less curl, even in the case of difficult hair that, for example, has lost its elasticity as a result of chemically-based colour changes.

The invention will be described in greater detail in conjunction with the drawings of an embodiment that are appended hereto.

Figure 2:
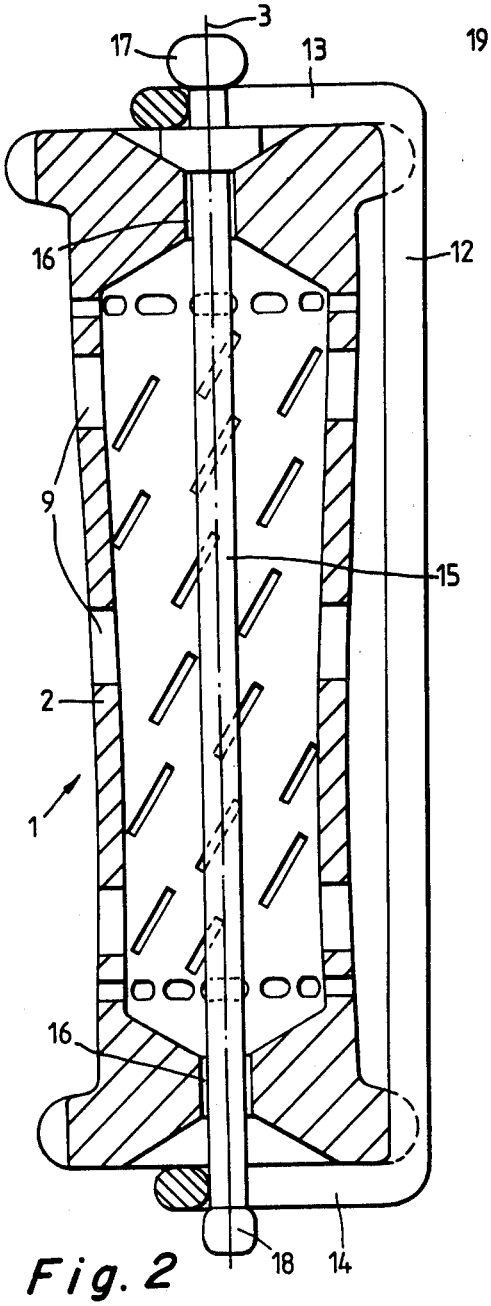
FIG. 2 is a longitudinal section through the permanent wave roller according to FIG. 1.
Figure 1:
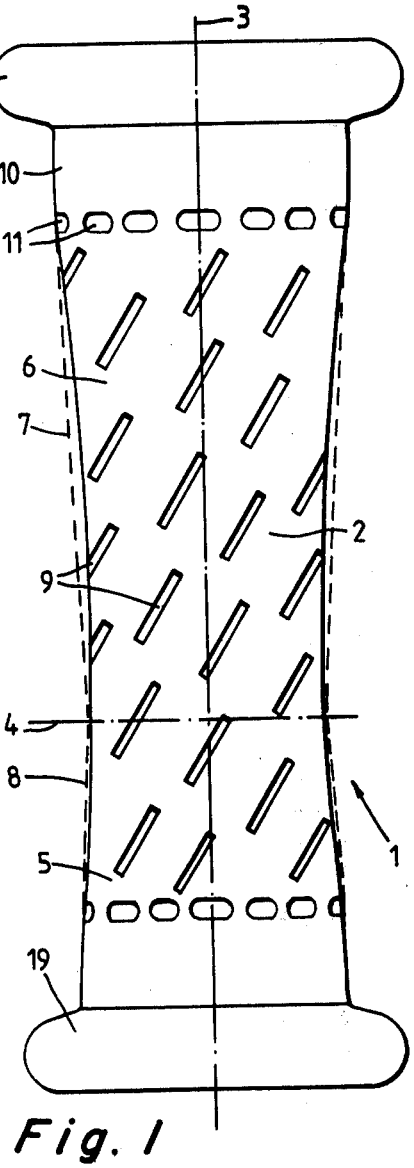
FIG. 1 is a side view of the permanent wave roller according to the invention.
Figure 3:
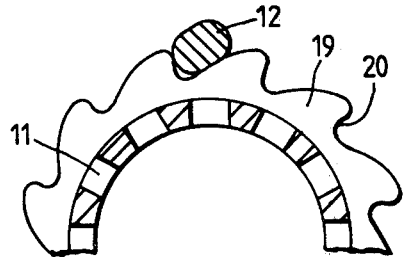
FIG. 3 is an end elevation of the permanent wave roller as in FIG. 1, after removal of the bail chip.

The permanent wave roller 1 as in FIGS. 1 to 3 contains a rotationally symmetrical winder tube 2 having a rotation or longitudinal axis 3. The winder tube has three segments that are contiguous in the direction of the longitudinal axis 3, namely a middle segment 4 and two outer segments 5 and 6. The middle segment 4 has the smallest outside diameter, whereas the outside diameters of the two outer segments 5 and 6 become in each case gradually greater from the end with which the segments 5 and 6 abut against the middle segment 4, and at which they are of the same outside diameter as the middle segment, towards the adjacent end of the winder tube 2. The two outer segments 5 and 6 are of different lengths, so that the middle segment 4, as can be clearly seen in FIG. 1, is arranged asymmetrically between the outer segments 5 and 6 i.e., the two outer sections 5 and 6 are not mirror images.

In addition, the two outer segments 5 and 6 are configured in the main conically. The diameter of these segments does not, however, increase per unit length by equal stages in each case, as would be the case with an exact cone, as is indicated by the dotted lines 7 and 8, but by gradually increasing increments from the end abutting the middle segment 4 to the outer end of the permanent wave roller 1. Thus the outer casing lines of the segments 5 and 6 are slightly concave, as is shown to an exaggerated extent in FIG. 1, vis-a-vis the lines 7 and 8 that would be obtained using a precisely conical arrangement. This leads to the pronounced advantage that the hair can be wound on spirally from outside to inside and vice versa from inside to outside without it losing its grip on the roller or the upper layers of hair falling off because they are too loose, as would be the case if the segments 5 and 6 were configured as pure cones.

The lengths of the two outer segments 5 and 6 are best proportioned at a ratio of at least 2:1. These dimensions have proven to be particularly advantageous in view of the different application possibilities of the permanent wave roller, that is characterized in particular by the fact that for the purpose of achieving different results the winding process can be started or finished, respectively, at the outer end of the long or the short segment 6 or 5, respectively, or the tips can be wound onto one or the other segment 5 or 6, respectively.

The outside diameter of any outer segment is at any one place—viewed in the direction of the longitudinal axis 3—smaller by approximately one to a maximum of three millimeters than the outside diameter measured at the same point in the case of an imaginary conical configuration of the two outside segments 5 and 6. In other words, the distance of the two lines 7 and 8, that correspond to the imaginary conicity, from the actual casing surface of the segments 5 and 6 is at no place greater than approximately 3 millimeters, the concavity thus being greater, the thicker the winder. This will prevent the hair sliding along the concave-conical segments 5 and 6. Furthermore, the conicity or concavity, respectively, of the casing surface of the winder cylinder 2 is relatively small and, for example, small enough that the maximum outside diameter of the two outer segments 5 and 6 is at a maximum approximately 8 mm greater than the outer diameter of the middle segment 4, this depending on the length and the thickness of the winder. This ensures that no sharp waves will be formed by an excessive difference in diameters along the length of the permanent wave roller 1, and permanent waves in which the curls become increasingly tight from the root to the tip of the hairs, or vice versa, will be obtained.

A number of holes are provided in the casing surface of the winder tube 2; these holes assist the drying process and facilitate the escape of residual liquid or dampness, respectively.

At the outer ends of the two outer segments 5 and 6 there is in each case an annular section 10 that is narrower or shorter, respectively, in comparison to the segments 5 and 6. These annular sections have elongated holes 11 disposed around them and the longitudinal axes of these holes are perpendicular to the longitudinal axis of the winder tube 2. Pins can be inserted through these elongated holes 11. The annular sections 10 are conical or configured like the segments 5 and 6, although the slope of the cone or the increase in outside diameter per unit length, respectively, is smaller than in the area of the segments 5 and 6.

A bail type clamp 12 is provided to secure the hair; the middle section of this clamp extends longitudinally along the winder tube 2 and has two end sections 13 and 14 that are bent at right-angles; a pin that extends through the winder tube 2 and is held in this by two bearings 16 passes through these and holds them. One end of the pin 15 is thus permanently held, although moveably so, by one bent-down end 13 of the bail clamp 12, and provided with a finger grip 17, whereas the other end of the pin 15 has a lock 18 that protrudes through a suitable opening in the other bent-down end 14 of the bail clamp 12 and according to the position to which it has been rotated either permits the end 14 to be slid off the pin 15 or the pushed-on end 14 to be arrested in the position shown in FIG. 2. When the end 14 is released, the whole of the bail clamp 12 can be swung away from the winder tube 2 by virtue of its elasticity and its loose mounting on the end 13, so that the winder tube 2 is free for the hair to be wound on.

A holder ring 19, that is comparitively narrower or shorter, respectively, abuts against the annular sections 10 from the outside; this holder ring 19 has saw-tooth serrations around is periphery, as can be seen in FIG. 3, and these hold the middle section of the bail clamp 12 and make it easier to manipulate smaller permanent wave rollers 1.

It is preferred that the winder tube 2, the bail clamp 12 and the pin 15 be of wood or plastic. The three segments 4,5,6, the two annular sections 10 and the two holder rings together form one continuous part.

Under the terms of the invention it is also preferred that a set of permanent wave rollers according to FIGS. 1 to 3 be produces or used, respectively, the three segments 4, 5 and 6 being of lengths, outside diameters and outside diameter increases that are in keeping with the hair length and/or structure, and in which the increase in outside diameter per unit length can be varied according to the hair length and/or structure.

Further possible variations of the permanent wave roller 1 that has been described can be seen in the fact that the segment 4 need not only represent a very narrow transitional zone between the two segments 5 and 6, as can be seen from FIG. 1, but can be configured so as to be relatively long in the direction of the longitudinal axis 3 and be of a continuous and constant diameter. The length of the segment 4 should not, however, be greater than approximately 12 mm. In addition, familiar elastic bands, strings, or the like, can be used in place of the bail clamp 12 in order to secure the hair. Furthermore, the peripheral shape and the length of the annular section 10 can be varied as viewed in the direction of the longitudinal axis.

It is expedient that the rise of the lines 7 and 8 that represent a precise cone shape be different. The lengths, outside diameters and outside diameter increases per unit length of the permanent wave roller according to the invention that are based on the hair length and/or hair structure and preferably provided emerge from the following table, which at the end contains three examples for familiar permanent wave rollers.

| Maximum outside diameter of segment 6,mm | Outside diameter segment 4,mm | Maximum outside diameter of segment 5,mm | Total length of all three segments mm |
|---|---|---|---|
| 8.0 | 7.5 | 7.8 | 120.0 |
| 8.0 | 6.8 | 7.0 | 120.0 |
| 12.0 | 11.0 | 11.5 | 60.0 |
| 12.0 | 10.0 | 10.5 | 60.0 |
| 10.0 | 9.0 | 9.5 | 60.0 |
| 10.0 | 9.0 | 9.2 | 60.0 |
| 10.0 | 8.0 | 9.0 | 50.0 |
| 8.0 | 7.5 | 7.8 | 40.0 |
| 8.0 | 6.8 | 7.0 | 40.0 |
| 12.0 | 11.5 | 11.7 | 40.0 |
| 12.0 | 9.7 | 10.0 | 40.0 |
| 14.0 | 11.0 | 14.0 | 80.0 |
| 13.0 | 8.0 | 13.0 | 85.0 |
| 7.0 | 4.0 | 7.0 | 65.0 |

As the table shows, it is possible to achieve much finer graduations using the permament wave rollers according to the invention than is the case with familiar and comparable permanent wave rollers.

I claim:

1. A permanent wave roller having a rotationally symmetrical winder rod or winder tube and a hair clamp, the winder rod or winter tube, respectively, consisting of three segments that are contiguous to each other in the direction of the rotational axis, of these three segments the middle one being of the smallest diameter, whereas in each case the outside diameter of the two outer segments increases gradually from its end adjacent to the middle segment towards the adjoining winder end, characterized in that the two outer segments (5,6) are of different lengths and that in each case the increase in the outside diameter of the two outer segments (5,6) per unit length increases gradually from the side adjacent to the middle segment (4) to the adjoining winder end such that the maximum outside diameter of the two outside segments (5,6) is at the most approximately 8 mm greater than the outside diameter of the middle segment (4).

2. A permanent wave roller according to claim 1, characterized in that the ratio of the lengths of the two outer segments (5,6) to each other is at least 2:1.

3. A permanent wave roller according to claim 1 or claim 2, characterized in that the outside diameter of either outer segment (5,6) at any place is at most one to a maximum of three millimeters smaller than the outside diameter resulting from an imaginary conical configuration of the two outer segments (5,6) at this place.

4. A permanent wave roller according to one of the claims 1 or 2, characterized in that the winder tube (2) has openings in the outer surface.

5. A permanent wave roller according to one of the claims 1 or 2, characterized in that at the outer ends of the two outer segments (5,6) there is in each instance an abutting annular section (10) having a number of elongated holes disposed around it, the axes of these holes being perpendicular to the longitudinal axis of the winder tube (2).

6. A permanent wave roller according to claim 1 or claim 2, characterized in that the hair clamp is a bail clamp (12), of which the middle part extends longitudinally along the winder tube (2) and which has two end parts (13,14) bent to form a right-angle, these being secured to the winder tube (2) by means of a pin (15) that extends through the winder tube (2).

7. A permanent wave roller according to claim 6, characterized in that at the outer ends of the two outer segments (5,6) there is in each instance a holder ring (19) having peripheral saw-tooth serrations (20) intended to hold the middle part of the bail clamp (12).

8. A permanent wave roller according to claim 6, characterized in that the winder rod or the winder tube (2) respectively, the bails clamp (12), and the pin (15) are plastic or wooden parts.

9. A permanent wave roller according to one of the claims 1 or 2, characterized in that the three segments (4,5,6) are of a length, outside diameter and/or outside diameter increase per unit length based on the hair length and/or hair structure.

10. A permanent wave roller according to one of the claims 1 or 2, characterized in that at an outside diameter of 4 to 20 mm its overall length amounts to 30 to 140 mm.

11. A permanent wave roller according to one of the claims 1 or 2, characterized in that an annular section (10) is adjacent to the outer end of at least one outside segment (5,6), the outside diameter of this annular section at the end adjoining the adjacent segment (5,6) being equal to the outside diameter of the outer end of this segment, and increasing from there in the direction of the adjoining winder end, although less steeply than in the area of the outer end of the adjacent segment (5,6).

12. A permanent wave roller according to claim 11, characterized in that the increase per unit length of the outside diameter of the annular section (10) is less than at the outer end of the segment (5,6), at least in the portion adjoining the adjacent segment (5,6).

13. A permanent wave roller according to claim 11, characterized in that the outside of the annular section (10) increases constantly.

* * * * *